United States Patent [19]

Bahlmann et al.

[11] Patent Number: 4,891,863

[45] Date of Patent: Jan. 9, 1990

[54] DEVICE FOR OPENING FIBER BALES

[75] Inventors: Bernd Bahlmann, Steingriff; Johann Walk, Eichstaett, both of Fed. Rep. of Germany

[73] Assignee: Schubert & Salzer Maschinenfabrik Aktiengesellschaft, Ingolstadt, Fed. Rep. of Germany

[21] Appl. No.: 255,225

[22] Filed: Oct. 11, 1988

[30] Foreign Application Priority Data

Oct. 13, 1987 [DE] Fed. Rep. of Germany ..... 3734556

[51] Int. Cl.[4] ..... D01G 7/00

[52] U.S. Cl. ..... 19/80 R

[58] Field of Search ..... 19/80 R, 105

[56] References Cited

U.S. PATENT DOCUMENTS

| | | | |
|---|---|---|---|
| 3,360,831 | 1/1968 | Morikawa et al. | 19/80 R |
| 3,389,435 | 6/1968 | Schwab et al. | 19/80 R |
| 4,514,881 | 5/1985 | Hergeth et al. | 19/80 R |

*Primary Examiner*—Werner H. Schroeder
*Assistant Examiner*—D. Price
*Attorney, Agent, or Firm*—Dority & Manning

[57] ABSTRACT

For a device for opening fiber bales, with an opening device capable of traveling on traveling rails along fiber bales set up in rows. A supporting wall is provided which is capable of being shifted in the direction of bale set-up. Orderly setting up of the fiber bales is ensured in a simple manner by means of the supporting wall.

5 Claims, 2 Drawing Sheets

DEVICE FOR OPENING FIBER BALES

BACKGROUND OF THE INVENTION

The instant invention relates to a machine for the opening of fiber bales, with an opening device which is capable of travelling on travelling rails alongside fiber bales set up in a row (or in rows) alongside the travelling rails.

For opening and mixing, a method is known by which certain fiber bales are set up in one or two or more rows alongside travelling rails, on which a device which successively removes fiber material from the base, can travel. See German publications DE-PS 2,939,890; DE-OS 3,321,802). As a rule, cotton bales of rectangular form are uncovered and are set up in a row on the floor in such manner that their long sides are essentially parallel to the travelling rails.

With this device, an operator, possibly using auxiliary means, must see to it that the bales are set up at a predetermined pattern and, as far as possible, at equal distance from the travelling rail, and that they do not tip over as they are set down on the floor. This method is unsatisfactory and, furthermore, can result in malfunctions if the operator forgets to remove auxiliary means, e.g., rods in the floor, before the opening device is started up.

SUMMARY OF THE INVENTION

It is the object of the instant invention to provide a device which ensures orderly setting up of the fiber bales in a simple manner.

This object is attained through the invention in that the fiber bales are assigned a supporting wall which can be shifted in the direction of bale set-up.

In a further embodiment of the invention, the supporting wall is installed on a carriage. The carriage is preferably capable of being shifted on a travelling rail of the opening device so that the supporting wall, and with it the bales which it supports, are always at the same distance from the travelling rail.

The supporting wall can, however, be installed on the opening device and can serve, at the same time, to support the bales during fiber removal during the bale surface by the opening device. An adaptation of the supporting wall to different bale heights is made possible through the fact that the supporting wall can be adjusted in a vertical direction.

BRIEF DESCRIPTION OF THE DRAWINGS

Two embodiments are described below through the drawings in which.

DETAILED DESCRIPTION OF THE DRAWINGS

Figure 1:
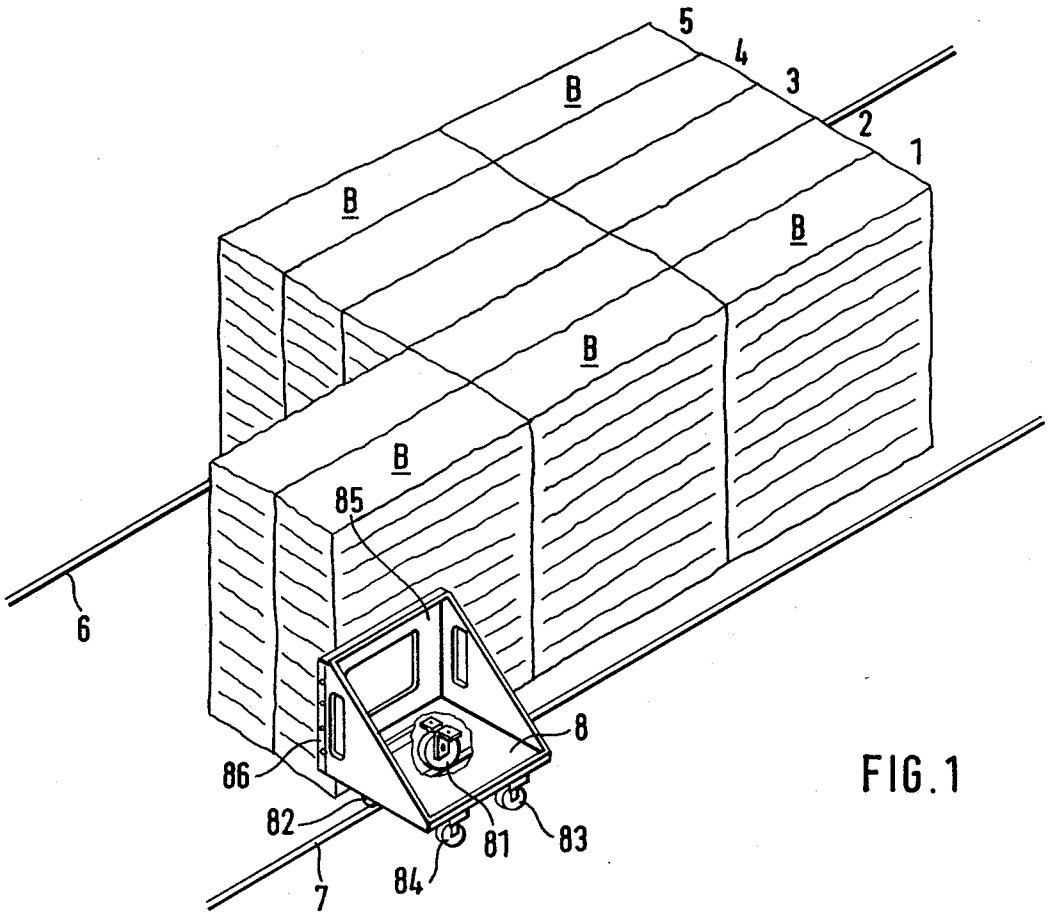
FIG. 1 is a perspective view of a row of bales and a carriage equipped with a supporting wall.

It can be recognized in FIG. 1 that the fiber bales B are set up in adjoining rows 1, 2, 3, 4 and 5 between two travel rails. A opening device (not shown in detail in FIG. 1) which is suspended from a bridge element of a portal-like machine frame and which extends over the five rows of bales, travels on the rails 6 and 7. The bales are rectangular in form and are set up with their long sides essentially parallel to the travel rails 6 and 7.

The setting up of the fiber bales B is facilitated by a carriage 8 with the pair of wheels 81, 82 running on the travel rail 7, while the second pair of wheels 83, 84 is located at a distance from rail 7, outside of the bale area. A face wall of the carriage 8 is turned towards the bales and constitutes a stop or supporting wall 85 for the fiber bales. The carriage 8 is always brought to the level of the readiness area for the first bale B which is to be set down on the floor next to the travel rail 7, and prevents the bale from coming into a tipping position and from falling on the rail 7, providing that the supporting wall 85 is of an appropriate height. Carriage 8 can also be displaced on an additionally provided rail, or the rail can be dispensed with.

As soon as a traverse row of bales has been constituted in relation to rails 6 and 7, the carriage is shifted along rail 7 for the setting up of the next transverse row. The carriage 8 not only provides support to the bale with its supporting wall, but also ensures that the bales are always set up at a predetermined, and always uniform, distance from rail 7. To be able to use the carriage for different bale heights, the supporting wall 85 is made so that it can be adjusted in the vertical direction, for example by sliding in lateral guides 86, and so that it can be fixed at the desired height by means of catches.

After the bales are properly aligned or set up using carriage 8 and the wall for setting up the bales, carriage 8 and the guide wall supported by carriage 8 is removed from rail 7 and the opening device, which is suspended from a bridge element of a portable machine frame, travels on rails 6 and 7 and extends over the rows of the bales to open the fibers in bales B.

Figure 2:
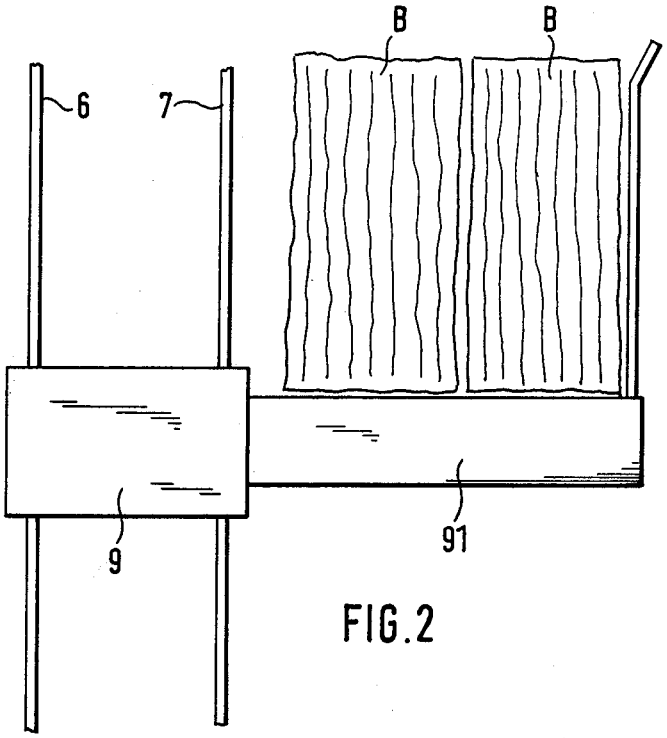
FIG. 2 shows the supporting wall provided for a traveling opening device, in top view.
Figure 3:
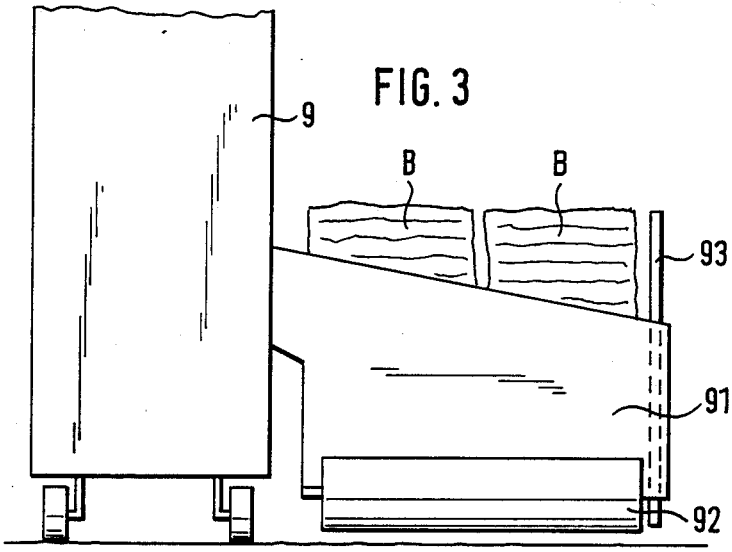
FIG. 3 shows the device of FIG. 2 in a side view.

The carriage 8, together with its supporting wall 85, can of course also be used as a set-up guide for the fiber bales when the bales are not set up between the rails, but as is shown in FIGS. 2 and 3, outside the rails of the opening device, in only one or two rows alongside the rails.

In the embodiment of the invention shown in FIGS. 2 and 3, the opening device itself is used as the setup guide for the fiber bales B. The opening device consists of a tower 9 with a boom 91, in which a plucking roller 92, equipped with teeth or needles, is supported. A supporting wall 93 is disposed on boom 91 of the opening device. The supporting wall is brought to the required supporting height before setting up the bales B by lowering the boom 91. Following the setting up of the bale or bales of one row, the opening device, together with the supporting wall 93 is shifted for the setting up of the next row of bales. The supporting wall 93 can, furthermore, be supported on the boom 91 so as to be capable of shifting freely in the vertical direction, and can be prevented by a stop from sliding out of its guide. The supporting wall 93 can also exert a supporting function upon the bales during the removal, by the plucking roller, of the fiber material from the bale surface.

What is claimed is:

1. In an opening machine for removing fiber from one or more stationary rows of bales supported on the floor, having an opening device which is supported on travelling rails for travel alongside said rows of bales, bale guide means comprising:

(a) A guide wall, spaced a predetermined distance from said travelling rails; and (b) movable supporting means for supporting said guide wall, adapted to shift said guide wall transversely of said rows of bales for aligning each of said rows at a predetermined distance from said traveling rail.

2. In an opening machine as set forth in claim 1, wherein said guide wall is supported on an independent movable supporting means.

3. In an opening machine as set forth in claim 2, wherein said independent movable supporting means comprises a carriage with one or more wheels adapted to travel on one of said traveling rails.

4. In an opening machine as set forth in claim 1, wherein said movable supporting means for supporting said side wall is disposed on said opening device.

5. In an opening machine as set forth in either of claims 1 through 4, wherein the height of said guide wall is adjustable in a vertical direction.

* * * * *